US007141075B1

(12) United States Patent
Stackhouse et al.

(10) Patent No.: US 7,141,075 B1
(45) Date of Patent: Nov. 28, 2006

(54) PROCESS FOR SELECTIVE DECOLORIZING FABRIC

(75) Inventors: James Stackhouse, Selmer, TN (US); Stuart Bradley Williamson, Cypress, CA (US)

(73) Assignee: Fiberzone Technologies Inc., Adamsville, TN (US)

( * ) Notice: Subject to any disclaimer, the term of this patent is extended or adjusted under 35 U.S.C. 154(b) by 0 days.

(21) Appl. No.: 11/224,581

(22) Filed: Sep. 12, 2005

Related U.S. Application Data

(63) Continuation-in-part of application No. 10/951,051, filed on Sep. 26, 2004, now abandoned.

(51) Int. Cl.
*D06L 3/04* (2006.01)

(52) U.S. Cl. ..... 8/111; 8/102

(58) Field of Classification Search ..... 8/111, 8/102
See application file for complete search history.

(56) References Cited

FOREIGN PATENT DOCUMENTS

WO WO 95/13415 * 5/1995

* cited by examiner

*Primary Examiner*—Lorna M. Douyon
*Assistant Examiner*—Amina Khan
(74) *Attorney, Agent, or Firm*—John Lezdey

(57) ABSTRACT

A process for removing dye on the surface of synthetic textiles and cotton utilizing ozone. The process also prevents redeposit of dye which is residual in a dyeing process. The time and temperature of the process is dependent upon the type of dye and the temperature the process is run. The process can be used in vat dyeing, jet dyeing, package dyeing and the like.

7 Claims, No Drawings

PROCESS FOR SELECTIVE DECOLORIZING FABRIC

RELATED APPLICATION

This is a Continuation-in-Part of application Ser. No. 10/951,051 filed Sep., 26, 2004 now abandoned.

FIELD OF THE INVENTION

The present invention relates to a process for selectively decolorizing threads, yarns and fabrics. More particularly, there is provided a process for removing or decolorizing dye which is plated or surface dyed on the threads, yarns or fabrics utilizing ozone.

BACKGROUND OF THE INVENTION

Processes for stripping dyes from or decolorizing various materials are known in the art. For example, U.S. Pat. No. 4,227,881 discloses a process for stripping dyes from textile fabric which includes heating an aqueous solution of an ammonium salt, a sulfite salt and an organic sulfonate to at least 140 degree F. (60 degree C.) and adding the dyed fabric to the heated solution while maintaining the temperature of the solution. In addition to the costly heating and temperature maintenance step, this process has the drawback of producing fabric which after processing exhibits a remaining color depth. U.S. Pat. No. 4,783,193 discloses a process for stripping color from synthetic polymer products by contacting the colored polymer with a chemical system. The described process uses unstable dispersions of alkyl halides and aqueous solutions of bleaching/oxidizing agents to which specified quantities of acids and surfactant/wetting agents are added. Among the drawbacks are the use of potentially hazardous halogens and the special provisions required to prevent escape of vapors which could cause environmental harm. Further, the use of the chemical system may restrict or eliminate the polymeric material's recycleability. In general, processes which utilize harsh stripping agents destroy the usefulness of the colorant, thus generating a chemical waste stream that must be treated or disposed of in an environmentally conscious manner. These methods can also generate unremovable colorant fragments which limit the downstream recycleability and utility of the color-stripped material. The methods are not suitable for selectively removing dye from the surfaces only of the textile material.

It is known to decolorize and desize dyed cellulosic fabric utilizing ozone, for example U.S. Pat. No. 5,366,510 to Wasinger. Dyes for cellulosic fibers have five major color application categories designated specifically for this chemical fiber type. Direct, vat, sulfur and reactive, along with azoic combinations. This is in sharp contract to dyeing man-made fibers which include acetate, acrylic, modacrylic, nylon, polyester and polyurethane fibers which are chemically diverse, mostly hydrophobic and are colored by disperse dye application. The most important fibers, polyester, nylon and cellulose acetate are generally disperse dyed. Acrylic and modacrylic can be dyed with both basic and disperse dyes. On acrylic fibers disperse dyes do not build well.

Japanese Patent No. 02004068170 to Tashiro et al published March, 2004 discloses the decolorization of an amine copolymer of polyaspartate at high temperatures in water with a stream of ozone.

However, the reference fails to selectively decolorize only the colorant from the surface without any substantial decolorization of the colorant in the fibers of the textile.

U.S. Pat. No. 4,012,357 to Foulks et al discloses bleaching esters with ozone, peroxide, hypochlorite, bleaching clays and the like. The process is not selective in only treating plated colorant as provided by the present invention and does not disclose bubbling ozone in a liquid for a specific time or temperature.

In batch dyeing the dye particles become associated with the surface of the synthetic fibers and then penetrate directly into the synthetic fiber. However, some dyes have the tendency to plate the surface of the fibers such as polyester before the dye has an opportunity to penetrate the fiber. Problems occur when there is an excess of soluble dye or disperse dye in the dye bath due to the concentration of the dye present exceeding the Saturation solubility of the dye at the particular dye temperature so that the dye does not transfer into the fiber but plates on the surface. It would be desirable to dissolve the plated dye which leads to specks.

Some of the problem found is when there is a mixture of fibers and the rate of dyeing and the temperatures of dyeing differ for each fiber so that the dye does not dissolve or penetrate into the fiber but plates the surface.

The problems in the industry are found when utilizing vat dyeing or mainstream equipment such as jets, wenches, beams or package dyeing.

Because disperse dyes have no or limited solubility in water, some particulate disperse dye may occlude to the fiber surface after the dyeing phase is complete. Excess dye on fiber surfaces results in adverse results such as reduced wet-fastness, wash-fastness, sublimation and dry cleaning fastness as well as dulling of shade.

The usual practice for removing unwanted dyes is called reduction clearing and uses a bath of caustic soda and sodium dithionite and a surfactant. The ease of removal varies from dye to dye and in some cases the dye is only partially reduced and results in a dull color.

Ozone is a powerful oxidizing agent which in many cases destroys the chemical structure of the dye so as to make it soluble or completely decolorizes the dye.

Unwanted dye is not only found on fabrics or yarns but can occur when equipment is used for multiple tasks or to run different dye batches. Deposited or excess dye is difficult to remove from washers or other equipment because it can enter different cracks or crevices in the washer or other equipment or to appear later during a run of a different dye batch. It would be advantageous to be able to dissolve and remove or decolorize the residual dye before beginning another operation in the washer or in other textile working equipment.

SUMMARY OF THE INVENTION

The present invention relates to a process for selectively decolorizing a colorant on the surface of textile goods which have been dyed or upon which colorant had been deposited. The process comprises treating the textile goods in an aqueous bath with ozone for a period of time to decolorize or remove the colorant from the surface without any substantial decolorization of dye in the fibers of the textile.

Advantageously, the ozone is put into the treating bath as ozone gas or diluted with an inert gas or air.

The process can be utilized to prevent redeposit of dye which has been left in the bath because of a previous dyeing process or to pre-treat the bath prior to the addition of the textile goods.

It is therefore an object of the invention to remove colorant from the surface of textiles without any substantial discoloration in the textiles.

It is a further object of the invention to prevent redeposit of colorants onto the surface of dyed textiles.

It is yet another object of the invention to remove colorant from the surface of synthetic textile surfaces.

It is still another object to treat a dye bath to destroy or decolorize any dye from a previous textile treatment which contains residues of previous dyes which may be redeposited onto the textiles.

It is understood that the terms "textile goods" and "textile substrates" relate to fibers, yarns, fabrics or garments.

It is also understood that the term "colorants" includes direct dyes, reactive dyes, disperse dyes and pigments which are commonly utilized in the dyeing or coloring of the textiles.

DESCRIPTION OF THE PREFERRED EMBODIMENTS

In accordance with the invention there is provided a means for removal or decolorization of colorants on the surface of textiles which would interfere with the aesthetic appearance and characteristics of the textile. This includes dyes which have been deposited from a previous fabric treatment process. More particularly the process involves the use of ozone to treat a textile in a bath at a temperature and for a period of time wherein only a surface dye or colorant would be decolorized or removed as a result of the reaction with ozone. The temperature can be ambient or elevated depending upon the textile and the dye.

Colorants of textiles comprise a large catalog of chemical structures. Some of these chemical structures can be oxidized to a soluble form, can be destroyed so as to be soluble or decolorized or to merely exist in a decolorized form.

For cellulosic textiles including denim, muslim, and chambray, azoic, basic, direct, mordant, oxidative, fiber reactive, sulfur, and vat dyes are employed. For the bast fibers (line, flax, hemp, jute, ramie, etc.) acid, direct, fiber reactive, vat, and solubilized vat dyes are suitable.

In polyamide fibers such as nylon-6, nylon 6—6, and nylon 6–10, acid, disperse, mordant, pigment, and fiber reactive dyes are preferred for both background dyeing and selected redyeing. Disperse dyes and pigments are employed for polyester fabrics. For acrylic fibers such as Creslan®, Acrilan®, Orlon®, and Courtelle®, basic disperse and pigment dyes are best employed. Disperse colors are used for polyolefin fabrics. Basic and disperse colors are used for polyvinyl chloride fabrics. Elastomeric fabrics such as Lycra® may be dyed with acid, disperse, fiber reactive, and vat dyes. Interesting stylish effects can be generated with the process of the present invention for such fashion, elastomeric garments as women's swim wear.

Fiber-reactive dyes are preferred for those categories of fabric with which they can be used, as listed above, because they react with the substrate to form covalent chemical bonds, rather than dyeing by mere secondary forces or occlusion. Within the category of fiber-reactive dyes there are at least four classes. All four are available from PRO Chemical & Dye Inc. Somerset, Mass. 02726, a distributor. The Mx series Sumbit Supra (DYSTAR) and Cibacron C (Ciba) are the most reactive and most versatile, comes in 43 colors, but has the shortest shelf life. These dyes set even at ambient temperature. The F series is slightly less reactive but has four times the shelf life. Higher dyeing temperatures of 41 degree–43 degree C. are recommended. The F series is the Cibacron F class of reactive dyes from Ciba, who are internationally known under the trade name of Ciba these days. Liquid reactive dyes from Clarinant Corp. are used best at 60 degree C. and are best set by steaming. The H series are available as both powder and liquids especially for printing and painting on natural fibers, such as cotton, wool and silk. The redyeing is done at 80 degree C. followed by steam setting at room temperature.

As a result of the different characteristics of the dyes and the temperatures which are required for the ozone to react, each textile must be pre-tested to determine the temperature and time of exposure to ozone to accomplish the effective removal or discolorization of the colorant or dye.

A large majority of disperse dyes are monoazo dyes of low molecular weight which can be cleaned by oxidation. Others have an anthraquinon structure which is difficult to reduce. Most direct dyes contain 4 to 7 aromatic rings and contain the azo chromophore as well as a sulphonate group. Direct black dyes comprise two or more colorants which form into disperse dyes. One form is of a combination of navy blue shaded with red or rubine and a yellow-brown or orange component.

As a result of the differences in chemical structures, in order to achieve the objects of the invention it is generally required to determine the type of dye or colorant that has been utilized in order to arrive at the proper parameters to oxidize the colorants without affecting either the fibers or the colorant within the fiber. In the case of synthetic fibers such as polyesters, the dye within the fiber is slightly affected by the ozone and the ozone has little effect in degrading the fibers. The colorant or dye on the surface of the fiber is therefore exposed to the oxidation effects of the ozone.

Generally, temperatures between 50° and 120° F. preferably between 50° and 100° F. are sufficient to dissolve the oxidation components of the colorant or dye utilized. Cellulosic fibers because of the reactive dyes require higher temperatures, generally about 80°–120° F. Many dyes can also be treated at ambient temperatures.

Black dyes are an exception because most black dyes comprise more than one dye and care must be taken so as to decolorize only the surface dye which causes the discoloration.

Combination of yarns formed with polyester and cotton fibers many times are dye plated at the twists of the fibers.

In accordance with one embodiment of the invention, ozone is produced according to U.S. Pat. Nos. 5,366,510 and 5,939,030 which are herein incorporated by reference for use either in a dye bath or after rinsing the dyed textile. Ozone may be used above or in combination with a gas, for example, air or dissolve in the bath. The ozone levels dissolved in the bath or treating liquid can be adjusted before the textile is placed in the bath so as to oxidize or destroy any residue in the bath which may plate onto the textile or the ozone can be added to the bath already containing the textile. Micro-processors can be used to monitor the system to maintain suitable concentrations dependent upon the application. Preferably, a sample of the dyed textile is pre-tested to determine the operating parameters for the temperature and the time of exposure to the ozone. No pre-testing is required when a washer or bath is pretreated to eliminate any residual colorants prior to treatment of the textiles.

Residence time in the ozonated bath is dependent upon the colorant or dye and the type of fiber or textile structure. Generally for synthetic fibers about 3 to 5 minutes is required at temperatures at least 50° F. to 120° F. since only the plated dye or colorant is to be removed. Cellulosic fibers usually contain reactive dyes and temperatures about 100° F. for 3 to 10 minutes depending upon the dye are required.

Without limitation, some of the preferred embodiments of this invention are set forth in the following examples.

EXAMPLE 1

In a rotating washer-extractor containing 10 gallons of water held at a temperature of 100° F. was bubbled ozone from an ozone generator. Three yards of Fruit of the Loom 100% cotton knit pre-dyed with reactive black dye, and taken from the dye process before the first salt rinse was placed into the washer and tumbled with ozone bubbled therein for three minutes. The fabric was extracted and dried.

Results

A crock test pursuant to AATCC method 8-1996 showed that the textile held shade and had a gray scale reading of 5. Only the surface was affected by the ozone. The process can be used in other equipment such as in jet dyeing.

EXAMPLE 2

Following the procedure of Example 1, 3 yds. of the cotton knit were placed into the washer-extractor containing 10 gallons of water with a bath temperature of 120° F. and with ozone being bubbled therein. The textile was tumbled for 8 minutes and then extracted and dried.

Results

The crock test showed a 5% loss of color and a gray scale reading of 5. The additional time appeared to be the factor for the loss of color.

EXAMPLE 3

Following the procedure of Example 1, 3 yds. of the cotton knit were placed in the washer-extractor containing 10 gallons of water with a bath temperature of 120° F. and with ozone being bubbled therein. The fabric was tumbled for 20 minutes and then extracted and dried.

Results

The crock test showed a 20% loss in color and a gray scale of 5.

The additional time was a factor in the loss of color.

The additional exposure resulted in the loss of color.

The process can be used similar for yarn in package dyeing.

EXAMPLE 4

Following the procedure of Example 1, 3 yds. of 100% polyester suede dyed with direct black were placed into the washer-extractor containing 10 gallons of ozonated water with a bath temperature of 65° F. and with ozone being bubbled therein. The fabric was tumbled for 45 minutes and then extracted and dried.

Results

The crock test showed a 20% loss of color and the fabric had a green cast. The fabric had a gray scale measurement of 4.5–5.

The prolonged time resulted in the color loss of one of the dye components of the black dye.

EXAMPLE 5

Following the procedure of Example 4, 3 yds. of 100% polyester suede fabric dyed black with direct dye were placed into a washer-extractor containing 10 gallons of water at a temperature of 65° F. with ozone being bubbled therein. The fabric was tumbled 30 minutes, extracted and dried.

Results

The crock test showed a 10% loss in color with a gray scale of 4.5 to 5. The fabric had a blue cast which indicated one of the dye components was oxidized.

EXAMPLE 6

Into each of three washer-extractors containing 10 gallons of water pretreated with ozone at 65° F. were placed 3 yds. of Morgan fabrics 100% polyester suede dyed with disperse black dye.

Sample 1 was tumbled 5 minutes, extracted and dried.

Sample 2 was tumbled 10 minutes, extracted and dried.

Sample 3 was tumbled 15 minutes, extracted and dried.

Results

The crock test showed the following:

Sample 1 held the shade and had a gray scale of 3–4.

Sample 2 had a 5% color loss and a gray scale of 3–4.

Sample 3 had a 10% color loss and a gray scale of 3–4.

The fabric held its color on shorter exposure to ozone.

EXAMPLE 7

Into each of three washer-extractors containing 10 gallons of water were placed 3 yds. of Fruit of the Loom 100% cotton knit which were dyed with reactive black dye.

Ozone was bubbled into the washer-extractor.

Sample 1 was tumbled in a bath at 100° F. for 3 minutes, extracted and dried.

Sample 2 was tumbled in a bath at 120° F. for 8 minutes, extracted and dried.

Sample 3 was tumbled in a bath at 65° F., for 20 minutes, extracted and dried.

Results

The crock tested showed the following:

Sample 1 held its shade and had a gray scale at 4.5.

Sample 2 had a slight color loss and a gray scale at 4.5.

Sample 3 had a 10% color loss and a gray scale at 5.

Time of exposure to ozone and not temperature was critical in loss of color for cotton.

What is claimed is:

1. A process for selectively decolorizing a colorant on the surface of polyester goods in a bath which comprises treating the polyester goods with ozone in an aqueous bath for a period of 3 to 5 minutes at a temperature between 50° F. and 120° F. to remove or decolorize a colorant plated on the surface of the polyester goods without effecting the dye within the fiber and without degradation of the fiber.

2. The process of claim 1 wherein a gas comprising ozone is bubbled into said bath containing said polyester goods.

3. The process of claim 1 wherein said bath is ozone enriched prior to the addition of said polyester goods.

4. The process of claim 1 wherein the plated colorant is a disperse dye or direct dye.

5. A process according to claim 1 including the step of preventing the redeposit of a colorant on a polyester textile substrate in an aqueous bath in which the textile substrate is to be placed which comprises pre-treating said bath with ozone whereby any colorant in said bath is oxidized or decolorized prior to the addition of said textile substrate.

6. The process of claim 5 wherein said bath is subsequently used to decolorize a dyed textile substrate.

7. The process of claim 5 wherein ozone or ozone and air is bubbled into said bath.

* * * * *